US006792709B1

(12) United States Patent
Fine et al.

(10) Patent No.: US 6,792,709 B1
(45) Date of Patent: Sep. 21, 2004

(54) DISPLAY DEVICE

(75) Inventors: Neil Fine, Northbrook, IL (US); Cliff Lan, Tsuen Wan (HK)

(73) Assignee: Neil Enterprises, Inc., Vernon Hills, IL (US)

( * ) Notice: Subject to any disclaimer, the term of this patent is extended or adjusted under 35 U.S.C. 154(b) by 64 days.

(21) Appl. No.: 09/938,910

(22) Filed: Aug. 24, 2001

(51) Int. Cl.[7] ..... A47G 1/06
(52) U.S. Cl. ..... 40/720; 40/738; 40/725
(58) Field of Search ..... 40/720, 725, 734, 40/722, 738; 119/257, 253, 248

(56) References Cited

U.S. PATENT DOCUMENTS

| | | | | |
|---|---|---|---|---|
| 777,305 A | | 12/1904 | Priestnall | |
| 1,627,270 A | | 5/1927 | Burnham | |
| 1,777,944 A | | 10/1930 | Trovato | |
| 1,991,683 A | * | 2/1935 | Kelly | 119/253 |
| 2,144,551 A | | 1/1939 | Skolnick | |
| 2,200,696 A | | 5/1940 | L'Heureux | |
| 2,548,706 A | | 4/1951 | Corning | |
| 3,771,246 A | | 11/1973 | Ebner | |
| 4,353,327 A | * | 10/1982 | Shroyer | 119/5 |
| 4,686,784 A | | 8/1987 | Smithies | |
| 4,879,824 A | | 11/1989 | Galloway | |
| 4,889,748 A | | 12/1989 | Dudley | |
| 4,944,969 A | | 7/1990 | Usui | |
| 5,090,358 A | * | 2/1992 | Waldman | 119/5 |
| 5,125,175 A | | 6/1992 | Huff | |
| 5,291,674 A | | 3/1994 | Torrence | |
| 5,853,824 A | | 12/1998 | Liu | |
| 5,979,091 A | | 11/1999 | TenBrink | |
| 6,027,774 A | | 2/2000 | Fine et al. | |

* cited by examiner

*Primary Examiner*—Cassandra H. Davis
(74) *Attorney, Agent, or Firm*—Patzik, Frank & Samotny Ltd.

(57) ABSTRACT

A display device having one or more liquid-filled chambers through which an object may be viewed as if it were submerged in liquid. The display device includes a frame member having four sides, at least two of the sides each having a viewing aperture. At least two substantially transparent liquid-filled chambers can also be provided in a side-by-side or back-to-back alignment, and are positioned within the frame member in substantial corresponding relationship with one of the viewing apertures.

25 Claims, 7 Drawing Sheets

DISPLAY DEVICE

FIELD OF THE INVENTION

The present invention relates generally to a display device, and specifically to a display device having one or more liquid-filled chambers behind which an object can be positioned so as to appear as if it is submerged when viewed through the chamber.

BACKGROUND OF THE INVENTION

Many types of display devices have been devised for displaying objects such as textual and pictorial images. Conventional display devices are often used in the retail industry for displaying advertising information. In addition, conventional display devices are most often used for personal use to display photographs.

Conventional display devices have been devised which include a frame member having transparent front portion, a rear portion, and a transparent liquid-filled cell positioned therebetween. A photograph or the like is positioned between the liquid-filled cell and the rear portion, so that the pictorial or textual image can be viewed through the cell and front portion.

However, such conventional display devices are inadequate, because they allow only one photograph or other object to be displayed at a time. Further, such conventional liquid-filled display frames only allow for viewing of a single object from one direction, namely, from the front portion of the frame member.

Therefore, it is a first object of the present invention to provide a liquid-filled display device which can display multiple pictorial or textual images simultaneously, while making such objects appear as if they are submerged in the liquid.

It is a second object of the present invention to provide a liquid-filled display device which can display pictorial or textual images for viewing from more than one direction while making such objects appear as if they are submerged in the liquid.

It is a third object of the present invention to provide a liquid-filled display device which is easy and economical to manufacture.

SUMMARY OF THE INVENTION

The above-listed objects are met or exceeded by the present apparatus for displaying pictorial and/or textual images and the like. A liquid-filled display device is provided having a frame member having four sides, at least two of the sides each having a viewing aperture. At least two substantially transparent liquid-filled chambers are also provided, and are positioned within the frame member in substantial corresponding relationship with one of the viewing apertures.

BRIEF DESCRIPTION OF THE DRAWINGS

Other objects and advantages of the invention will become apparent upon reading the following detailed description and upon reference to the drawings in which.

WRITTEN DESCRIPTION OF THE INVENTION

Figure 1:
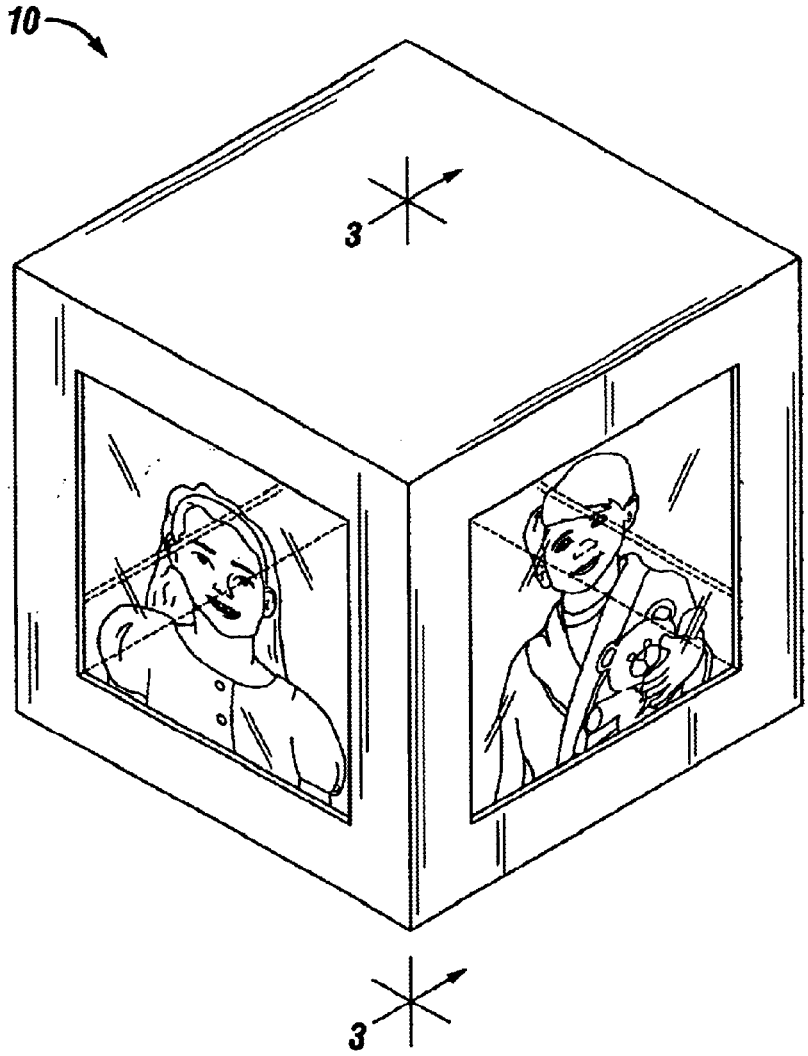
FIG. 1 is a top perspective view of a display device of the present invention.

While this invention is susceptible of embodiment in many different forms, there is shown in the drawings and will herein be described in detail, one specific embodiment, with the understanding that the present disclosure is to be considered merely an exemplification of the principles of the invention and is not intended to limit the invention only to the embodiment illustrated.

Figure 2:
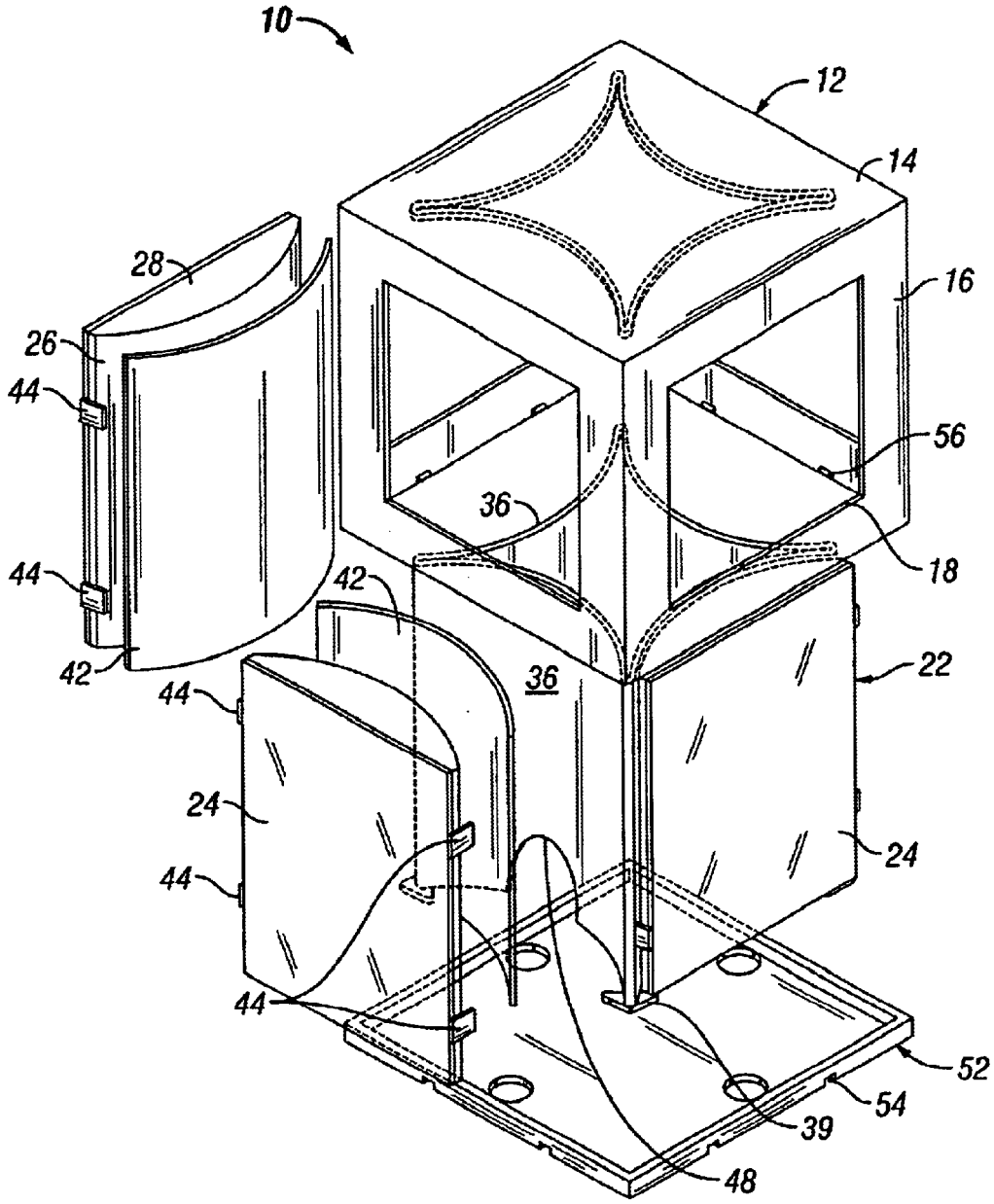
FIG. 2 is an exploded view of the display device of the present invention.

As shown in FIGS. 1 and 2, and as previously mentioned, the display device 10 of the present invention includes a substantially cubed-shaped frame member 12 having a frame member top wall 14 and four side walls 16, each side wall 16 having a viewing aperture defined by edge 18. Four liquid-filled chambers 22 are positioned within the frame member 12 such that the frame member 12 substantially surrounds the four chambers 22. However, alternate embodiments are contemplated wherein one or more chambers 22 are positioned in the frame member 12.

Figure 3:
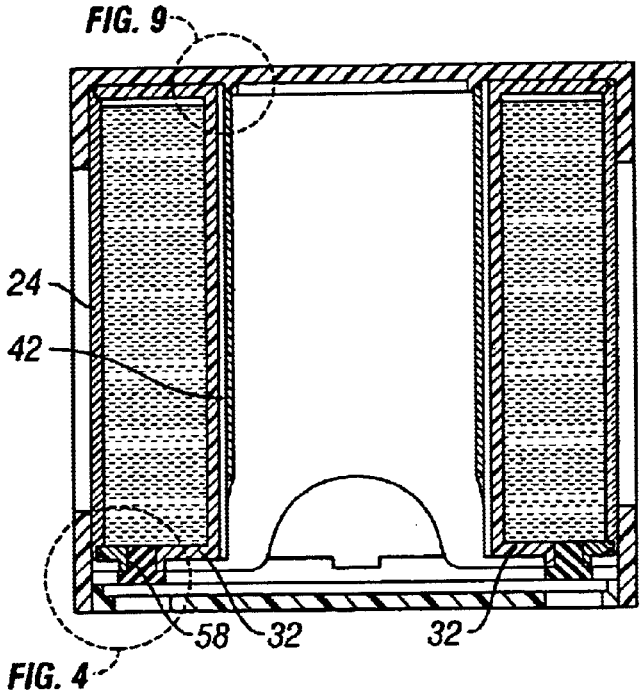
FIG. 3 is a cross-sectional diagram of the display device taken alone line 3—3 of FIG. 1.

Each chamber 22 includes a substantially planar and transparent front wall 24, an opposing curved and transparent rear wall 26, a chamber top wall 28, a chamber bottom wall 32 (see FIG. 3), and opposing chamber side walls 33. In the preferred embodiment, the rear wall 26 is convex-shaped. However, the rear wall 26 could also be concave-shaped or substantially flat as well. In addition, the front wall 24 could also be curved. The chamber top wall 28, bottom wall 32 and side walls 33 need not be transparent. It is preferred that the height and width of the chamber front wall 24 be of sufficient length to ensure that the edges of the front wall 24 are not visible through the aperture 18 when the chamber 22 is positioned within the frame member 12. Further, each chamber 22 is positioned within the frame member 12 so as to be in substantial alignment with one of the frame member side wall apertures 18, preferably so that the edges of the chamber front wall 24 are not visible through the aperture 18.

Dividing means for positioning the four chambers 22 within the frame member 12 is provided. In the preferred embodiment, the dividing means is a divider member 34 having four curved surfaces 36 positioned in substantially perpendicular relative relationship to each other. In the preferred embodiment, the curved surfaces 36 are concave-shaped. However, the curved surfaces 36 could also be convex-shaped, or some other shape that is equivalent or complimentary to the shape of the rear wall of the chamber, as well. In either case, it is preferred that shape of each curved surface 36 substantially correspond to that of the chamber rear side 26. As will be further discussed below, the divider member 34 is fixedly connected to the inside surface 38 (see FIG. 5) of the frame member top wall 14 by affixation means.

Retention means for retaining the chambers 22 within the frame member 12 is provided. In the preferred embodiment, the retention means are retaining tabs 38 extending from the bottom portion of each dividing member curved surface 36 which engage the chamber bottom wall 32 (See FIG. 3), thus substantially preventing the chamber 22 from sliding out of the frame member 12. In the preferred embodiment, two retaining tabs 39 are provided for each chamber 22. Further, in the preferred embodiment, the two retaining tabs 39 are positioned so as to engage the chamber bottom wall 32 proximal to the edge formed by the intersection of the chamber bottom and side walls 32, 33, respectively. However, the invention is not so limited. Alternate embodiments are contemplated wherein only one retaining tab 39 is employed, and/or wherein the retaining tab extends from an inside surface of the frame member 12.

Each chamber 22 is provided with a holder for positioning an object 42 relative thereto behind its rear wall 26, so as to enable viewing of the object 42 through the front wall 24 of the chamber 22. The holder may include one or more tabs (not shown) and/or clips (not shown) operably associated with the chamber 22, frame member 12 or divider member 34; an adhesive associated with the chamber 22, frame member 12 or divider member 34; and/or a void or slot formed behind the rear wall 26 of the chamber 22.

In the preferred embodiment, the holder is a slot or void. Slot defining means is provided for positioning each chamber 22 with respect to its corresponding divider member curved surface 36, so as to define the void or slot therebetween. In the preferred embodiment, the slot dividing means includes a plurality of positioning tabs 44 extending from each of the chamber side walls 33 in substantially perpendicular relationship to the front wall 24. The positioning tabs 44 contact the divider member curved surface 36 causing the chamber front side 24 to abut or contact the inside surface 44 of the corresponding frame member 16, which, in turn, forms a slot or void between the chamber rear surface 26 and the divider member curved surface 36. An alternate embodiment is contemplated wherein the tabs 44 extend from the divider member 34.

It is within the above-mentioned slot or void that the substantially planar object 42 is positioned for viewing through the frame member sidewall aperture 18 and in turn the chamber 22. The object 42 may be anything capable of being inserted into the slot or void, such as a photo, drawing, picture, advertisement or the like. Each divider member curved surface 36 is provided with a cutout defined by edge 48, which provides a means by which a user can grasp the object 42 for removal from the slot.

A removable bottom member 52 is provided having a plurality of apertures defined by edge 54. A plurality of corresponding rounded tabs 56 extend from the inside surface of the frame member sides 16, proximal to the bottom-most edge of each side 16. When the bottom member 52 is inserted into the frame member 12, the apertures 54 and tabs 56 cooperate so as to removably secure the bottom member 52 within the frame member 12.

The manufacture and assembly of the display device 10 will now be discussed with reference to FIGS. 3 through 9. In the preferred embodiment, the frame member 12, the components for the chambers 22, divider member 34, and bottom member 52 are manufactured using a thermoplastic material which is substantially impact resistant, lightweight and aesthetically pleasing, and are formed using conventional injection-molding equipment. The particular thermoplastic material employed will depend on the injection-molding process employed, and it should be understood that one with ordinary skill in the relevant art could readily choose the particular thermoplastic to be employed.

Figure 9:
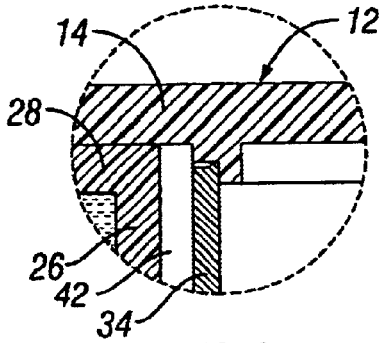
FIG. 9 is a magnified view of a pre-assembly cross-sectional view of the divider member and frame member taken from FIG. 3.

After the requisite parts have been formed, assembly of the display device 10 is carried out as follows. First, the chambers 22 are assembled. Referring to FIG. 9, in the preferred embodiment, the chamber curved rear wall 26, side walls 33, top wall 28 and bottom wall 32 form an integral member. A circular-shaped fill hole defined by edge 58 is formed through the bottom wall 32, preferably during the injection-molding process. A corresponding fill hole cap 62 is also provided. The chamber front wall 24 is fixedly attached to the above-noted integral member by affixation means. In the preferred embodiment, the affixation means includes joining the chamber front wall 24 to the integral member using a suitable joint in combination with a thermal welding method. Such methods include, but are not limited to, ultrasonic welding, vibration welding, radio-frequency welding, and electromagnetic or induction welding.

Figure 4:
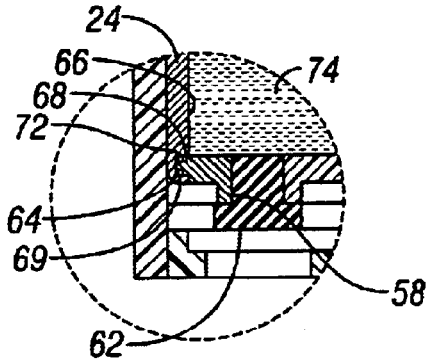
FIG. 4 is a magnified view of a cross-sectional view of a pre-assembled liquid-filled chamber taken from FIG. 3.

In the most preferred embodiment, the affixation means employed is an energy director joint design in combination with an ultrasonic welding method. Referring to FIG. 4, the chamber front wall 24 includes a recessed butt or contact surface 64 which extends around the periphery of the front wall inside surface 66. A corresponding sealing flange 68 having a triangularly-shaped energy director 69 extends from the flange's distal face 72. To assemble the front side 24 to the integral member, the front wall 24 is positioned so that the recessed butt or contacting surface 64 contacts the energy director 69. Using ultrasonic equipment, ultrasonic energy is then applied to the combination at the intersection of the butt or contacting surface 64 and the energy director 69, thereby causing the energy director 69 to melt and fixedly join the butt or contacting surface 64 with the flange distal face 72.

Next, the chamber 22 is filled with a liquid 74, which is inserted into the chamber 22 through the fill hole 58. In one embodiment, the chamber 22 is filled with a viscous liquid, such as glycerine, and contains particulate matter, such as sand, glitter and the like. In another embodiment, the chamber 22 is filled with a bubble producing substance, such as a surfactant, which causes bubbles to produce when the chamber 22 is agitated. In yet another embodiment, the liquid 74 may contain two or more liquids of varying polarity which, when the chamber 22 is agitated, form an emulsion or colloidal suspension. In addition, coloring pigments could be added to the liquid 74 to produce a coloring effect. The chamber 22 could also contain water or a gas such as air.

Once the chamber 22 is filled, the fill hole 58 is sealed using the fill hole cap 62. In the preferred embodiment, the fill hole cap 62 is fixedly secured using an adhesive, one which is preferably inert with respect to the liquid 74 inserted into the chamber 22. Alternate embodiments are contemplated wherein the fill hole cap 62 is fixedly secured using a thermal welding method.

Once the chambers 22 are assembled, the display device 10 can then be assembled. First, the divider member 34 is fixedly secured to the inside surface 38 of the frame member top wall 14 using affixation means. In the preferred embodiment, the affixation means includes joining the divider member 34 to the frame member 12 using a suitable joint in combination with a thermal welding method. Such methods include, but are not limited to, ultrasonic welding, vibration welding, radio-frequency welding, and electromagnetic or induction welding.

Figure 5:
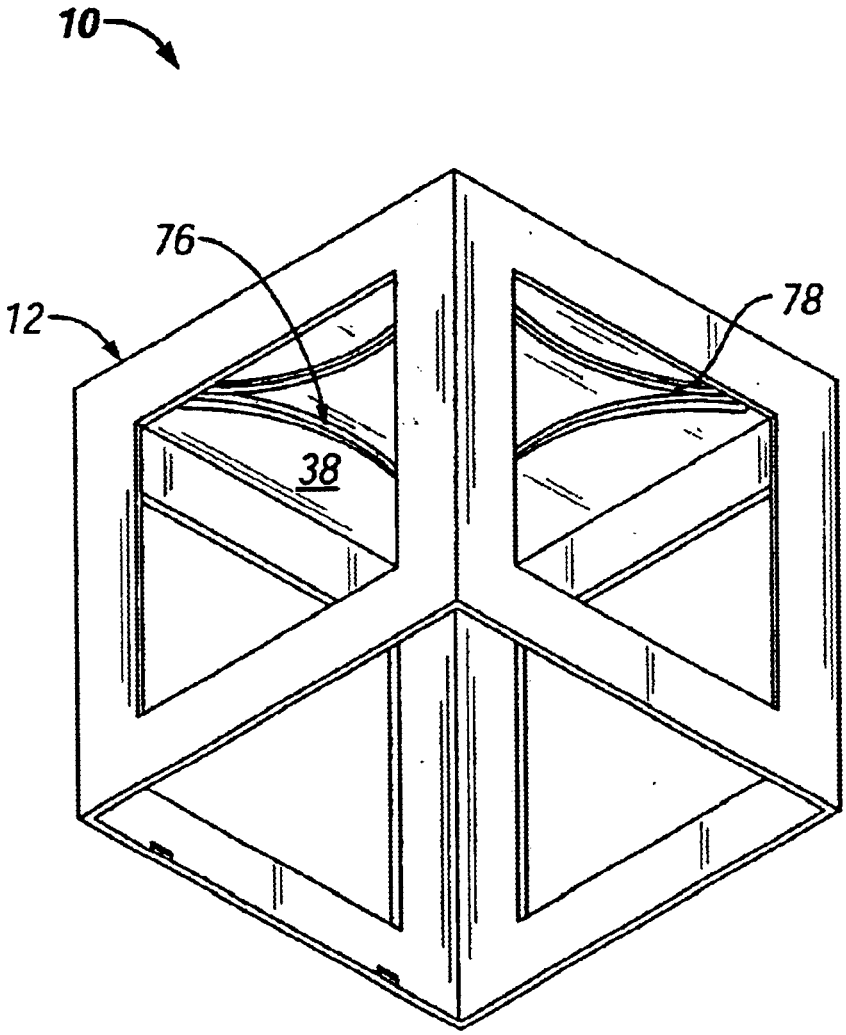
FIG. 5 is a bottom perspective view of a frame member.
Figure 6:
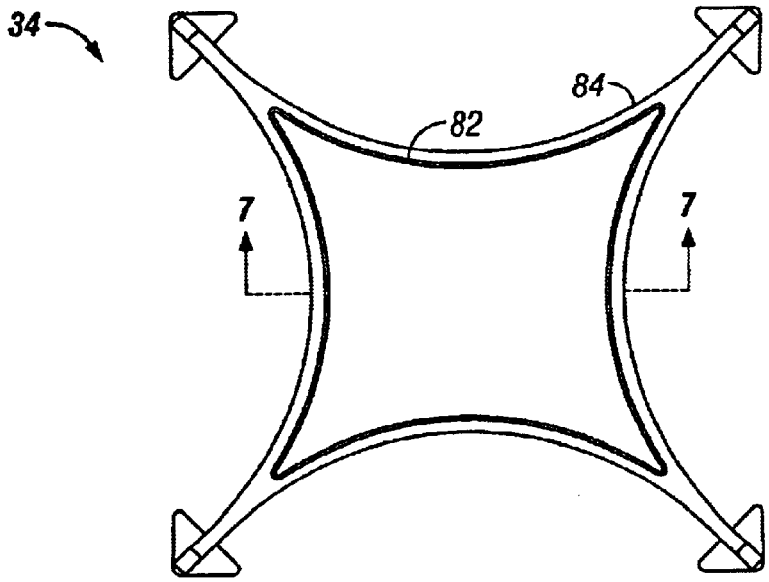
FIG. 6 is a top view of a divider member.
Figure 7:
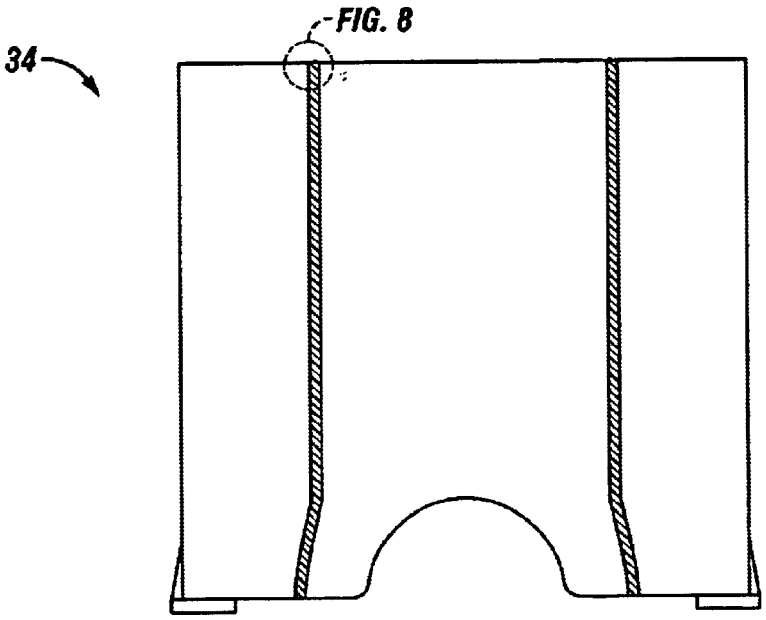
FIG. 7 is a cross-sectional diagram of the divider member taken cross line 7—7 in FIG. 6.
Figure 8:
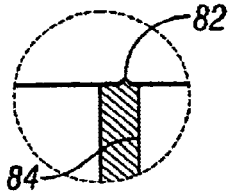
FIG. 8 is a magnified view of a cross-sectional view of an energy director taken from FIG. 7.

In the most preferred embodiment, the affixation means employed is an energy director joint design in combination with an ultrasonic welding method. Referring to FIG. 5, a joint member 76 having a butt or contact surface 78 extends from the frame member top wall inside surface 38. Referring to FIGS. 6, 7 and 8, a corresponding triangularly-shaped energy director 82 extending from the divider member's upper edge 84 is provided.

The assembly of the display device 10 is carried out as follows. Where the divider member 34 and the retention tabs 38 form an integral member, the chambers 22 are first positioned so that the chamber positioning tabs 44 and bottom surface 32 contact the divider member curved surface 36 and retention tabs 38, respectively. Thereafter, the combination is inserted into the frame member 12 so that, as shown in FIG. 8, the divider member energy director 82 contacts the frame member butt or contacting surface 78. Ultrasonic energy is then applied to the combination at the joint using ultrasonic welding equipment, thereby causing the energy director 82 to melt and fixedly join the butt or contacting surface 78 to the divider member upper edge 84.

In the alternative, where the divider member 34 and the retaining tabs 39 do not form an integral member, the divider member 34 is first secured to the frame member 12 as described above. Next, the chambers 22 are inserted into the space or void provided between the frame member side walls 16 and the divider member curved surface 36. Next, the retention retaining tabs 39 are fixedly secured to the bottom surface (not shown) of the divider member 34 using one of the above-noted thermal welding methods.

In either of the above two alternative embodiments, after the divider member 34 and chambers 22 are secured in the frame member 12, the bottom member 52 is secured within the frame member 12 by inserting the rounded tabs 56 into the apertures 54 provided in the bottom member 52, thus completing the manufacture and assembly process.

Figure 10:
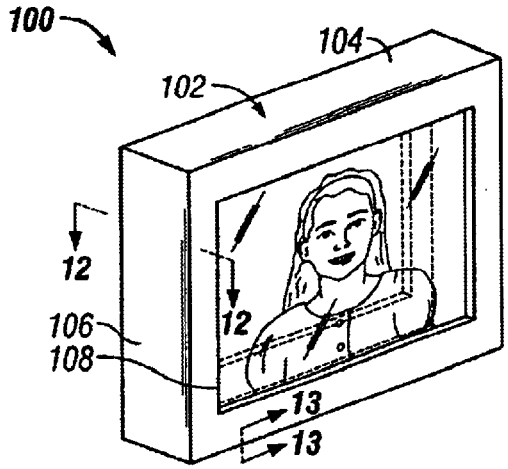
FIG. 10 is a perspective view of an alternate embodiment of the display device.
Figure 11:
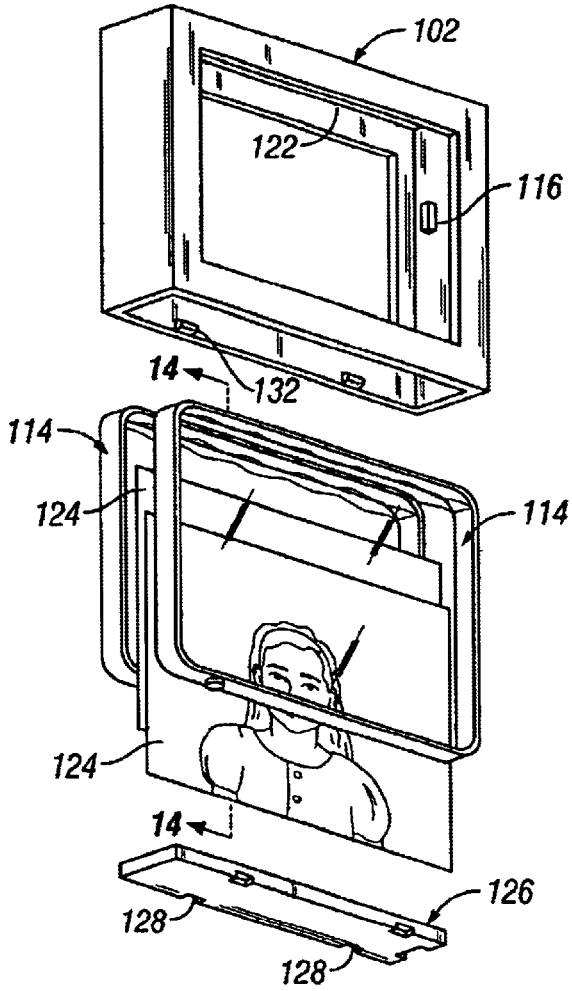
FIG. 11 is an exploded view of the alternate embodiment of the display device.
Figure 12:
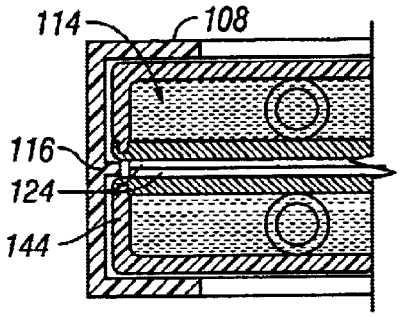
FIG. 12 is a cross-sectional diagram of the alternate embodiment of the display device taken alone line 12—12 of FIG. 10.

As shown in FIG. 10, and as previously mentioned, an alternate embodiment of the display device 100 of the present invention includes a substantially rectangularly-shaped frame member 102 having a top wall 104, two side walls 106 and two opposing viewing walls 108, each viewing wall having a viewing aperture defined by edge 112. As shown in FIG. 12, two liquid-filled chambers 114 are positioned within the frame member 102. Each chamber 114 is positioned within the frame member 102 so as to be in substantial alignment with one of the frame member side wall apertures 112.

Figure 13:
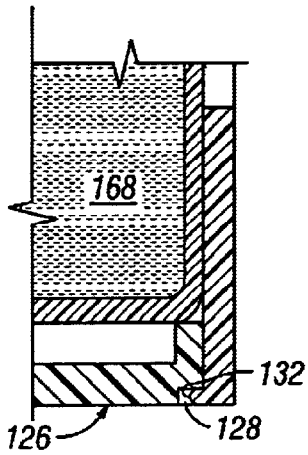
FIG. 13 is a cross-sectional diagram of the alternate embodiment of the display device taken alone line 13—13 of FIG. 10.

Slot defining means is provided for positioning the chambers 114 within the frame member 102 so as to define a slot between the two chambers 114. Referring to FIGS. 12 and 13 in combination, in the preferred embodiment, the slot defining means includes on or more separating tabs 116 extending from the inside surface 118 of the frame member side walls 106 in substantially perpendicular relationship thereto. The separating tabs 116 extend between the chambers 114, forcing the chambers 114 to abut or contact the viewing wall inside surfaces 122. It is within the above-mentioned slot or void that one or more substantially planar objects 124 are positioned. The one or more objects 124 may be anything capable of being inserted into the slot or void, such as a photo, drawing, writing, printed material, picture, advertisement, greeting card or the like.

Figure 14:
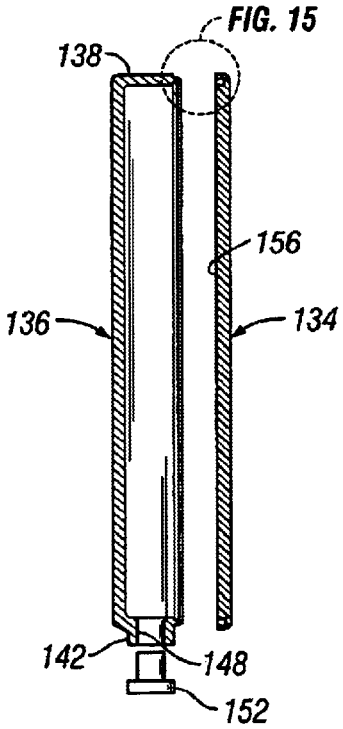
FIG. 14 is an exploded cross-sectional diagram of a liquid-filled chamber taken alone line 14—14 of FIG. 11.

A removable bottom member 126 is provided for removably securing the chambers 114 and one or more objects 124 within the frame member 102. The bottom member 126 includes a plurality of recessed regions defined by edge 128. A plurality of corresponding rounded tabs 132 extend from the viewing wall inside surfaces 122, proximal to the bottom-most edge of each wall 108. Referring to FIGS. 12 and 14, when the bottom member 126 is inserted into the frame member 102, the recessed regions 128 and tabs 132 cooperate so as to removably secure the bottom member 126 within the frame member 102.

Figure 15:
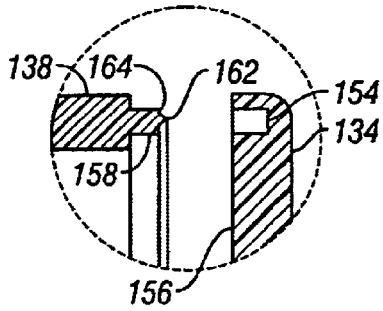
FIG. 15 is a magnified view of a cross-sectional view of a portion of the liquid-filled chamber taken from FIG. 14.

The manufacture and assembly of the alternate embodiment of the display device 100 will now be discussed with reference to FIGS. 12, 15 and 16. In the preferred embodiment, the frame member 102, the components for the chambers 114 and bottom member 126 are manufactured using a thermoplastic material which is substantially impact resistant, lightweight and aesthetically pleasing, and are formed using conventional injection-molding equipment. The particular thermoplastic material employed will depend on the injection-molding process employed, and it should be understood that one with ordinary skill in the relevant art could readily choose the particular thermoplastic to be employed.

After the requisite parts have been formed, assembly of the alternate embodiment of the display device 100 is accomplished as follows. First, the changers 114 are assembled. Referring to FIG. 9, each chamber 102 includes a substantially planar and transparent front wall 134, an opposing transparent rear wall 136, a chamber top wall 138, a chamber bottom wall 142 (see FIG. 2), and opposing side walls 144 (see FIG. 12). It should be noted that the chamber top wall 138, bottom wall 142 and opposing side walls 144 need not be transparent.

In the preferred embodiment, rear wall 136, top wall 138, side walls 144 and bottom wall 142 form an integral member. A circular-shaped fill hole defined by edge 148 is formed through the bottom wall 142, preferably during the injection-molding process. A corresponding fill hole cap 152 is provided. The chamber front wall 134 is fixedly attached to the above-noted integral member by affixation means.

In the preferred embodiment, the affixation means includes joining the chamber front wall 134 to the above-noted integral member using a suitable joint in combination with a thermal welding method. Such methods include, but are not limited to, ultrasonic welding, vibration welding, radio-frequency welding, and electromagnetic or induction welding.

In the most preferred embodiment, the affixation means employed is an energy director joint design in combination with an ultrasonic welding method. Referring to FIG. 16, the chamber front wall 134 includes a recessed butt or contact surface 154 which extends around the periphery of the front wall inside surface 156. A corresponding sealing flange 158 having a triangularly-shaped energy director 162 extends from the flange's distal face 164. To assemble the front wall 134 to the integral member, the front wall 134 is positioned so that the recessed butt or contacting surface 154 contacts the energy director 162. Using ultrasonic welding equipment, ultrasonic energy is then applied to the combination at intersection of the butt or contacting surface 154 and the energy director 162, thereby causing the energy director 162 to melt and fixedly join the butt or contacting surface 154 with the flange distal face 164.

Next, liquid 168 (see FIG. 14) is inserted into the chamber 114 through the fill hole 148. In one embodiment, the chamber is filled with a viscous liquid, such as glycerine, and contains particulate matter, such as sand, glitter and the like. In another embodiment, the chamber 114 is filled with a bubble producing substance, such as a surfactant, which causes bubbles to be produced when the chamber 114 is agitated. In yet another embodiment, the liquid 168 may contain two or more liquids of varying polarity which, when the chamber is agitated, form an emulsion or colloidal suspension. In addition, coloring pigments could be added to the liquid 168 to produce a coloring effect. The chamber 114 could also contain water or a gas such as air.

Once the chamber 114 has been filled, the fill hole 148 is sealed using the fill hole cap 152. In the preferred embodiment, the fill hole cap 152 is fixedly secured using an adhesive, one which is preferably inert with respect to the liquid 168 into the chamber 114. Alternate embodiments are contemplated wherein the fill hole cap 152 is fixedly secured using a thermal welding method.

Once the chambers 114 are assembled, the alternate embodiment of the display device 100 can then be assembled. First, the chambers 114 are inserted into the frame member 102 and positioned so that the separating tab 116 extends between the chambers 114. Next, the bottom member 126 is secured within the frame member 102 by inserting the rounded tabs 132 into the recessed regions 128 provided in the bottom member 126, thus completing the manufacture and assembly process.

The foregoing description of an embodiment of the invention has been presented for purposes of illustration and description, and is not intended to be exhaustive or to limit the invention to the precise form disclosed. The description was selected to best explain the principles of the invention and practical application of these principles to enable others skilled in the art to best utilize the invention in various embodiments and various modifications as are suited to the particular use contemplated. It is intended that the scope of the invention not be limited by the specification, but be defined by the claims as set forth below.

What is claimed is:

1. A display device having a plurality of sides for viewing one or more objects, comprising:

a first substantially transparent, liquid-filled chamber associated with a first side of said plurality of sides;

a second substantially transparent, liquid-filled chamber associated with a second side of said plurality of sides;

each of said chambers having a front wall and a rear wall and a holder operably associated therewith for receiving at least one of the one or more objects substantially behind said rear wall;

wherein said at least one of the one or more objects is substantially visible through said front wall and said rear wall of at least one of said first and second chambers when said at least one of the one or more objects is positioned substantially behind said rear wall of said at least one of said first and second chambers, so as to make said at least one of the one or more objects appear as if it is submerged in said liquid.

2. The display device of claim 1, wherein said rear wall of each chamber is curved.

3. The device of claim 1, wherein said holder of each of said first and second chamber comprises a slot formed behind said rear wall of each of said chambers for receiving at least one of said one or more objects to be displayed.

4. The display of claim 1, wherein said holder is selected from the group consisting of tabs, clips, and adhesives.

5. The display device of claim 1, further comprising dividing means for positioning said first chamber relative to said second chamber.

6. The display device of claim 1, further comprising a divider member operably associated with said first and second chamber for positioning said first chamber relative to said second chamber.

7. The display device of claim 6, further comprising at least one object interposed between said first chamber and said divider member.

8. The display device of claim 6, further comprising a first object interposed between said first chamber and said divider member; and a second object interposed between said second chamber and said divider member.

9. The display device of claim 6, further comprising a frame member substantially surrounding said first and second chambers.

10. The display device of claim 9, further comprising retention means for substantially retaining each of said first and second chambers within said frame member.

11. The display device of claim 9, further comprising retaining tabs operably associated with said divider member.

12. The display device of claim 9, further comprising a bottom member operatively associated with said frame member.

13. The display device of claim 6, wherein said divider member includes at least two substantially curved-shaped surfaces; and each of said first and second chambers includes a substantially curved rear wall.

14. A display device for viewing one or more objects, comprising:

a first substantially transparent, liquid-filled chamber;

a second substantially transparent, liquid-filled chamber;

a divider member operably associated with said first and second chambers for positioning said first chamber relative to said second chamber;

slot defining means for defining a slot between each of said first and second chambers and said divider member;

each of said first and second chamber having a front wall, a rear wall and a holder operably associated therewith for receiving at least one of the one or more objects substantially behind said rear wall; and wherein said at least one of the one or more objects is substantially visible through said front wall and said rear wall of at least one of said first and second chambers when said at least one of the one or more objects is positioned substantially behind said rear wall of said at least one of said first and second chambers, so as to make said at least one of the one or more objects appear as if it is submerged in said liquid.

15. A display device for viewing one or more objects, comprising:

a first substantially transparent, liquid-filled chamber;

a second substantially transparent, liquid-filled chamber;

a divider member operably associated with said first and second chamber for positioning said first chamber relative to said second chamber;

positioning tabs associated with each said first and second chambers and said divider member for defining a slot between each of said first and second chambers and said divider member;

each of said first and second chamber having a front wall, a rear wall and a holder operably associated therewith for receiving at least one of the one or more objects substantially behind said rear wall; and wherein said at least one of the one or more objects is substantially visible through said front wall and said rear wall of at least one of said first and second chambers when said at least one of the one or more objects is positioned substantially behind said rear wall of said at least one of said first and second chambers, so as to make said at least one of the one or more objects appear as if it is submerged in said liquid.

16. A display device for viewing one or more objects, comprising:

a first substantially transparent, liquid-filled chamber;

a second substantially transparent, liquid-filled chamber;

a divider member operably associated with said first and second chamber for positioning said first chamber relative to said second chamber;

a frame member substantially surrounding said first and second chambers;

at least one retaining tab operably associated with each said liquid-filled chamber for substantially retaining each said liquid filled chamber within said frame members each of said first and second chamber having a front wall, a rear wall and a holder operably associated therewith for receiving at least one of said one or more objects substantially behind said rear walls; and wherein said at least one of the one or more objects is substantially visible through said front wall and said rear wall of at least one of said first and second chambers when said at least one of the one or more objects is positioned substantially behind said rear wall of said at least one of said first and second chambers, so as to make said at least one of the one or more objects appear as if it is submerged in said liquid.

17. A display device for viewing one or more objects, comprising:

a first substantially transparent, liquid-filled chamber;

a second substantially transparent, liquid-filled chamber;

a divider member operably associated with said first and second chamber for positioning said first chamber relative to said second chamber, wherein said divider member is fixedly connected to said frame member;

a frame member substantially surrounding said first and second chambers;

each of said first and second chamber having a front wall, a rear wall and a holder operably associated therewith for receiving at least one of the one or more objects substantially behind said rear wall; and wherein said at least one of the one or more objects is substantially visible through said front wall and said rear wall of at least one of said first and second chambers when said at least one of the one or more objects is positioned substantially behind said rear wall of said at least one of said first and second chambers, so as to make said at least one of the one or more objects appear as if it is submerged in said liquid.

18. A display device having a plurality of sides for viewing one or more objects, comprising:

a first substantially transparent liquid-filled chamber associated with a first side of the said plurality of sides; and a second substantially transparent chamber associated with a second side of the plurality of said sides;

at least one of said first and second chambers having a holder operably associated therewith for receiving said one or more objects; and each of said first and second chambers having a front wall and a rear wall;

wherein at least one of said one or more objects is substantially visible through said front wall, a rear wall and said rear wall of at least said first chamber when the object is positioned substantially within said holder, so as to have the object appear as if it were submerged in the liquid.

19. The display device of claim 18, wherein said first and second chambers are each liquid-filled.

20. The display device of claim 19, further comprising a slot defining tab operably associated with said frame member and said first and second chambers for defining a slot between said chambers.

21. The display device of claim 18, wherein said holder is selected from the group consisting of tabs, clips, and adhesives.

22. The display device of claim 18, further comprising a frame member substantially surrounding said first and second chambers.

23. The display device of claim 22, further comprising a bottom member operatively associated with said frame member.

24. The display device of claim 22, further comprising slot defining means for defining a slot between said chambers.

25. The display device of claim 18, further comprising at least one object of said one or more objects interposed between said chambers.

* * * * *